US006786357B2

(12) United States Patent
Renard

(10) Patent No.: US 6,786,357 B2
(45) Date of Patent: Sep. 7, 2004

(54) VENDING MACHINE FOR CHEMILUMINESCENT NOVELTY ITEMS

(75) Inventor: Jerome Renard, Los Angeles, CA (US)

(73) Assignee: Oxalight L.L.C., Los Angeles, CA (US)

( * ) Notice: Subject to any disclaimer, the term of this patent is extended or adjusted under 35 U.S.C. 154(b) by 50 days.

(21) Appl. No.: 10/251,126

(22) Filed: Sep. 19, 2002

(65) Prior Publication Data

US 2004/0056041 A1 Mar. 25, 2004

(51) Int. Cl.[7] ..... B65H 1/00
(52) U.S. Cl. ..... 221/197; 221/277
(58) Field of Search ..... 221/266, 151, 221/197, 198, 205, 281, 277; 194/255; 512/42, 45

(56) References Cited

U.S. PATENT DOCUMENTS

| | | | | |
|---|---|---|---|---|
| 4,706,842 A | | 11/1987 | Guadagnino | |
| 5,450,980 A | * | 9/1995 | Laidlaw | 221/1 |
| 6,378,729 B1 | | 4/2002 | Kodama | |
| 6,401,464 B2 | | 6/2002 | Jones et al. | |

* cited by examiner

*Primary Examiner*—Kenneth Noland
(74) *Attorney, Agent, or Firm*—McHale & Slavin, P.A.

(57) ABSTRACT

A vending machine dispenses chemiluminescent necklaces upon payment of a fee. The machine has internal magazines which may be loaded with cartridges packaging the elongated necklaces. Elongated rotary dispensing mechanisms select one necklace for dispensing upon a correct payment.

10 Claims, 6 Drawing Sheets

FIG. 6
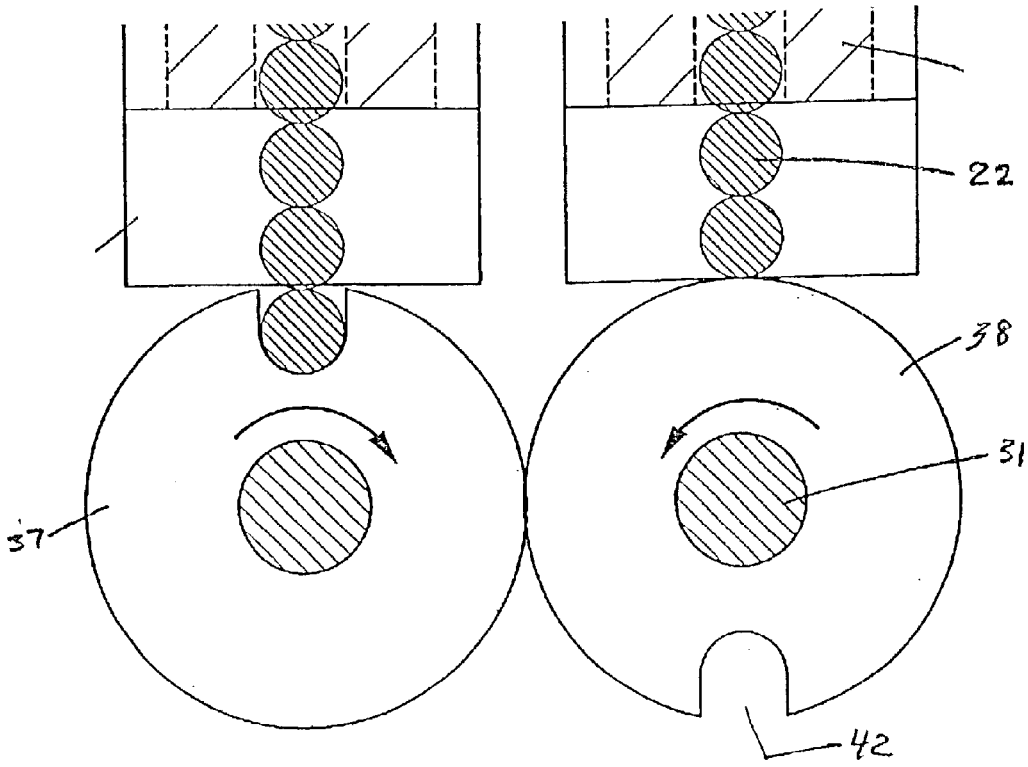
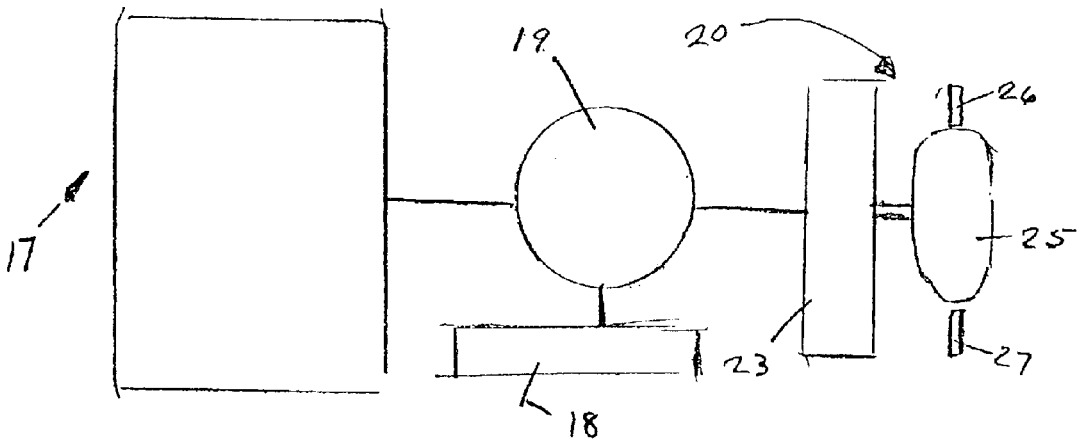
FIG. 7

VENDING MACHINE FOR CHEMILUMINESCENT NOVELTY ITEMS

FIELD OF THE INVENTION

This invention relates to vending machines for dispensing chemiluminescent novelty items, in particular necklaces or bracelets which can be illuminated.

BACKGROUND OF THE INVENTION

Chemiluminescent devices have become quite popular for temporary use at sporting events, concerts and other activities. These devices may be in the form of light sticks or they may be worn as adornment, such as necklaces, bracelets or head dress. In addition to illumination in reduced visibility, the devices provide multicolored lighting for aesthetic value. Further, in regard to safety, the devices provide illumination without heat.

The chemiluminescence is the result of mixing of the components a two component composition. The two components must be kept separated until the illumination is desired. Normally, this is accomplished by having two containers, one disposed within the other. For example, a necklace may be fabricated from an elongated flexible tube containing an activator. Within the tube is a smaller frangible container of the chemiluminescent component. Of course, the components may be reversed. By flexing or otherwise deforming the outer elongated tube, the inner container is ruptured. The two components mix initiating the illumination reaction. Clearly, it is important to protect the devices from inadvertent damage or rupture before illumination.

By placing the devices within a housing, the chances of accidental activation by a vendor or a potential customer are significantly reduced.

DESCRIPTION OF THE PRIOR ART

Vending machines are very common in today's commerce. They provide convenience for the consumer and reduced costs to the seller. Some of the common uses of vending machines are for dispensing food and drink.

U.S. Pat. No. 6,378,729 discloses a dispensing machine for storing medical ampules out of direct light. The ampules are dispensed by a rotary selector upon demand.

The patent to Yuyama et al, U.S. Pat. No. 5,862,942 is another ampule dispenser for dispensing single ampules from a connected series of ampules. The dispenser shows two storage areas and a rotary dispensing device.

Guadagnino, U.S. Pat. No. 4,706,842, is directed to a vending machine for dispensing pencils upon payment of a fee.

The Jones et al patent, U.S. Pat. No. 6,401,464 teaches the use of a cartridge or storage container inside a refrigerated dispenser.

U.S. Pat. No. 5,450,980 to Laidlaw teaches a vending machine for dispensing an individual cigarette upon insertion of a coin. The cigarettes are loaded in the machine by a removable hopper and dispensed by a slotted rotary dispensing member that is rotated by the coin mechanism.

The prior art does not show a vending machine capable of dispensing elongated flexible items without damage to the internal elements.

SUMMARY OF THE INVENTION

Disclosed is a vending machine that dispenses chemiluminescent necklaces upon payment of a fee. The machine has internal cartridges loaded with the elongated necklaces. Elongated rotary dispensing mechanisms select the item to be dispensed, namely an elongated flexible chemiluminescent item, such as a necklace, for dispensing upon a correct payment.

Accordingly, it is an objective of the instant invention to provide a vending machine to complete a sales transaction including collection of a fee and dispensing of the item.

It is a further objective of the instant invention to provide a vending machine for dispensing long flexible items having a frangible component without damage to the item.

It is yet another objective of the instant invention to provide a protective cartridge containing a multiplicity of elongated flexible items. The cartridge cooperates with the vending machine to provide a replaceable source of the items.

It is a still further objective of the invention to provide a vending machine for dispensing chemiluminescent tubes for illumination upon distortion.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE FIGURES

FIG. 6 is a cross section of the cartridge, selector and ejector with the selector in an intermediate position; and FIG. 7 is a schematic of the operation of the vending machine.

DETAILED DESCRIPTION OF THE INVENTION

Figure 2:
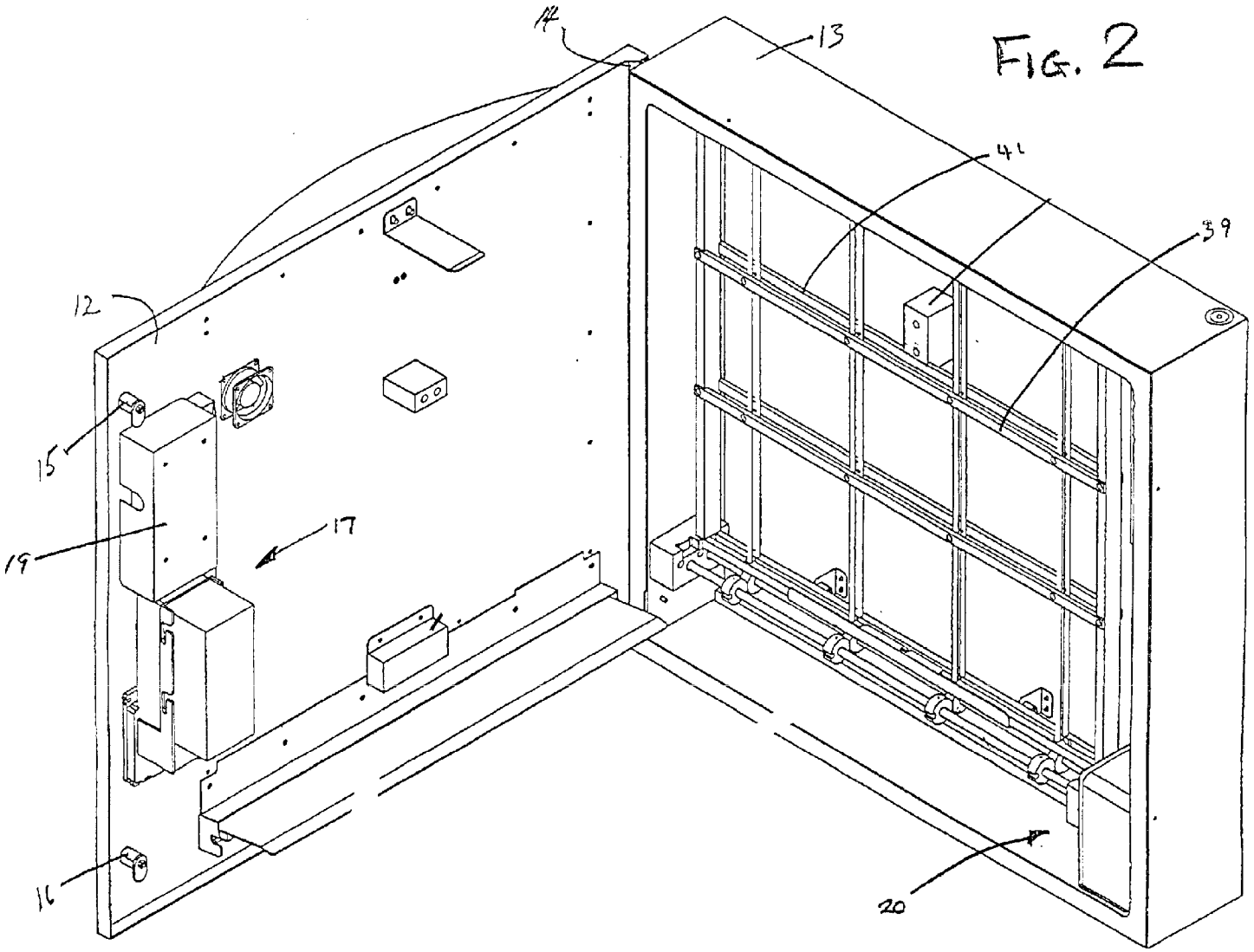
FIG. 2 is a perspective of the interior of the cabinet.

The housing for the vending machine 10 is a cabinet made of material to withstand normal usage, such as steel or other metals or polymeric materials. Preferably, the cabinet has a bubble display window 11 which is backlighted to illuminate the display. The vending machine 10 can be connected to a standard 110 volt, 60 cycle electrical circuit for all power requirements of the machine. As shown in FIG. 2, the front of the vending machine has a door 12 secured to the housing 13 by a hinge 14 and locks 15, 16 for security. The cabinet may be free standing or it may be attached to a support surface such as a wall, partition or stand.

Figure 1:
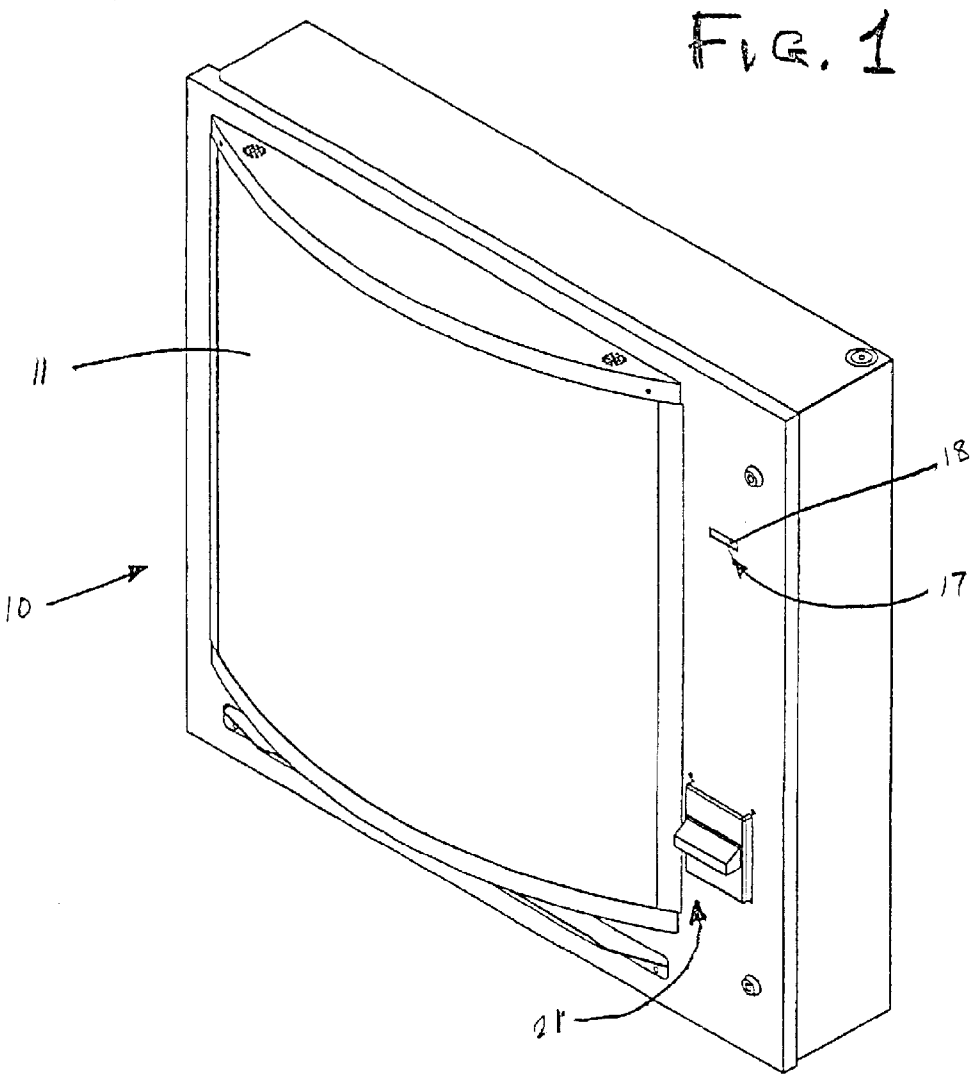
FIG. 1 is a perspective of the cabinet housing of the vending machine of this invention.

In FIG. 1, the vending machine 10 has a condition indicator 17 with a LED 18 to indicate whether the machine is operative or not. A currency slide 21 is provided for coin or payment accepted by the machine. The vending machine may be equipped with other payment devices including a bill changer or receipt reader, a credit/debit card reader and key pad and/or a voice activated or other electronic authorization system. The mechanism includes a validation feature to authenticate the type of payment used and assure proper payment. The Conlux USA Corp makes a model NBM 300 which is a bill changer-validator.

A controller 19, such as a computer, operates the vending machine 10 through operative connection to the payment device and the dispensing mechanism 20. When proper payment has been validated by said payment device 17, a signal is passed from the payment device to the controller 19, shown in FIG. 7, and the controller 19 authorizes the dispensing mechanism 20 to dispense an item from the internal cartridges.

The vending machine 10 is designed to dispense elongated flexible items, specifically chemiluminescent necklaces 22, without distortion of the interior of the necklaces. The necklaces 22 have sufficient length to encircle the human head. At each end of the necklaces 22, there are cooperating fastening devices to hold the necklaces in a closed circular configuration.

The necklaces 22 are stored in cartridges 39 and 40 in the machine in flat parallel stacks. The cartridges are removably held in the cartridge holders 51 and 52 on shaft brackets 30 and 35. A removable clip 50 closes the bottom of the cartridges. It is removed after they are loaded in the vending machine to permit dispensing through the cabinet opening. The dispensing mechanism 20 is of such dimensions to accommodate each necklace and it's fasteners as an elongated item.

Figure 3:
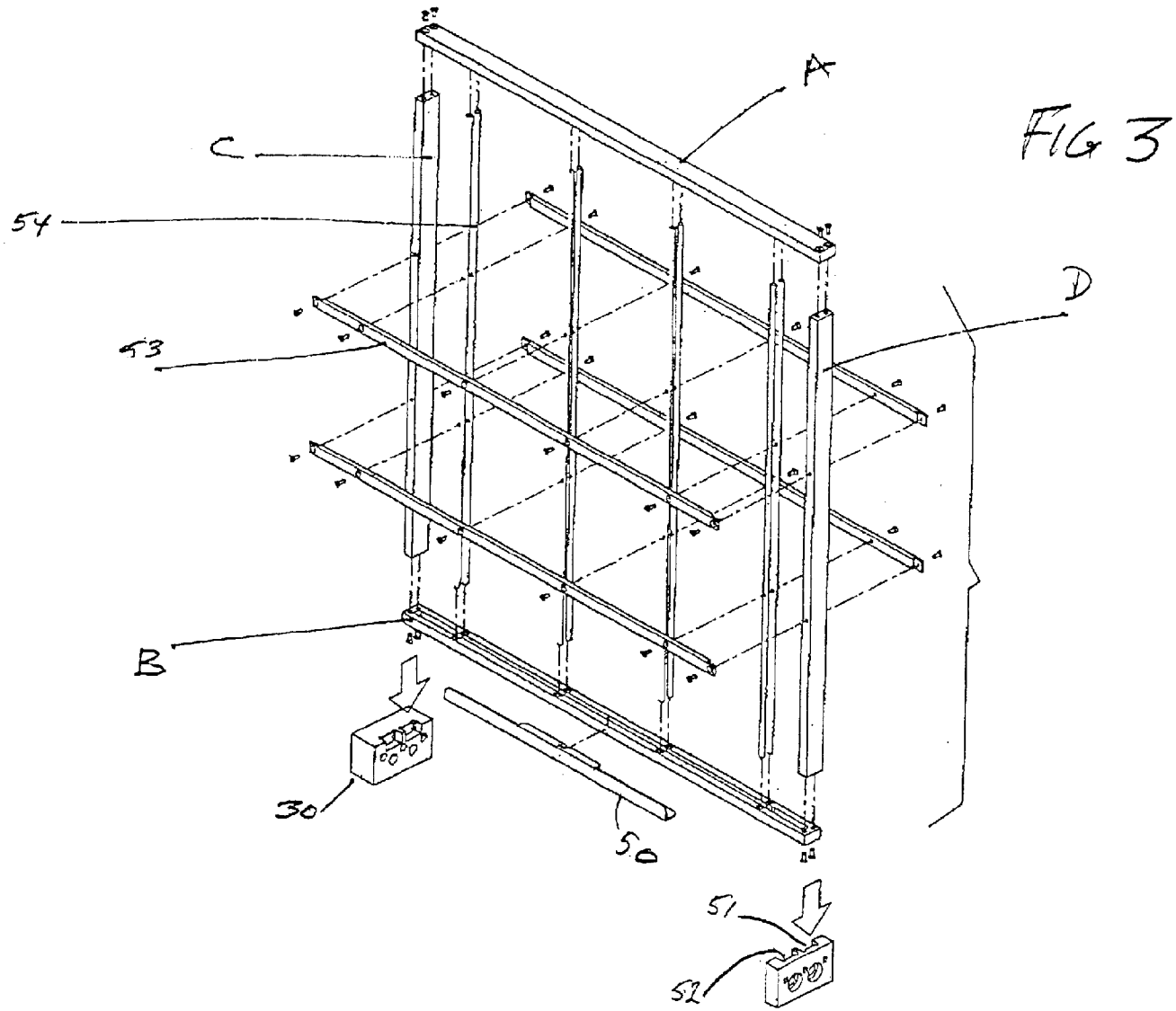
FIG. 3 is an exploded view of a cartridge.

The cartridges, as shown in FIG. 3, are each an open framework of horizontal rods 53 and vertical rods 54 held by frame members A, B, C, and D. Within this framework, several necklaces are loaded parallel with members A and B. This protects the necklaces until they are dispensed by the vending machine. Further, the cartridges permit quick and safe filling of the vending machine by the operator.

Figure 4:
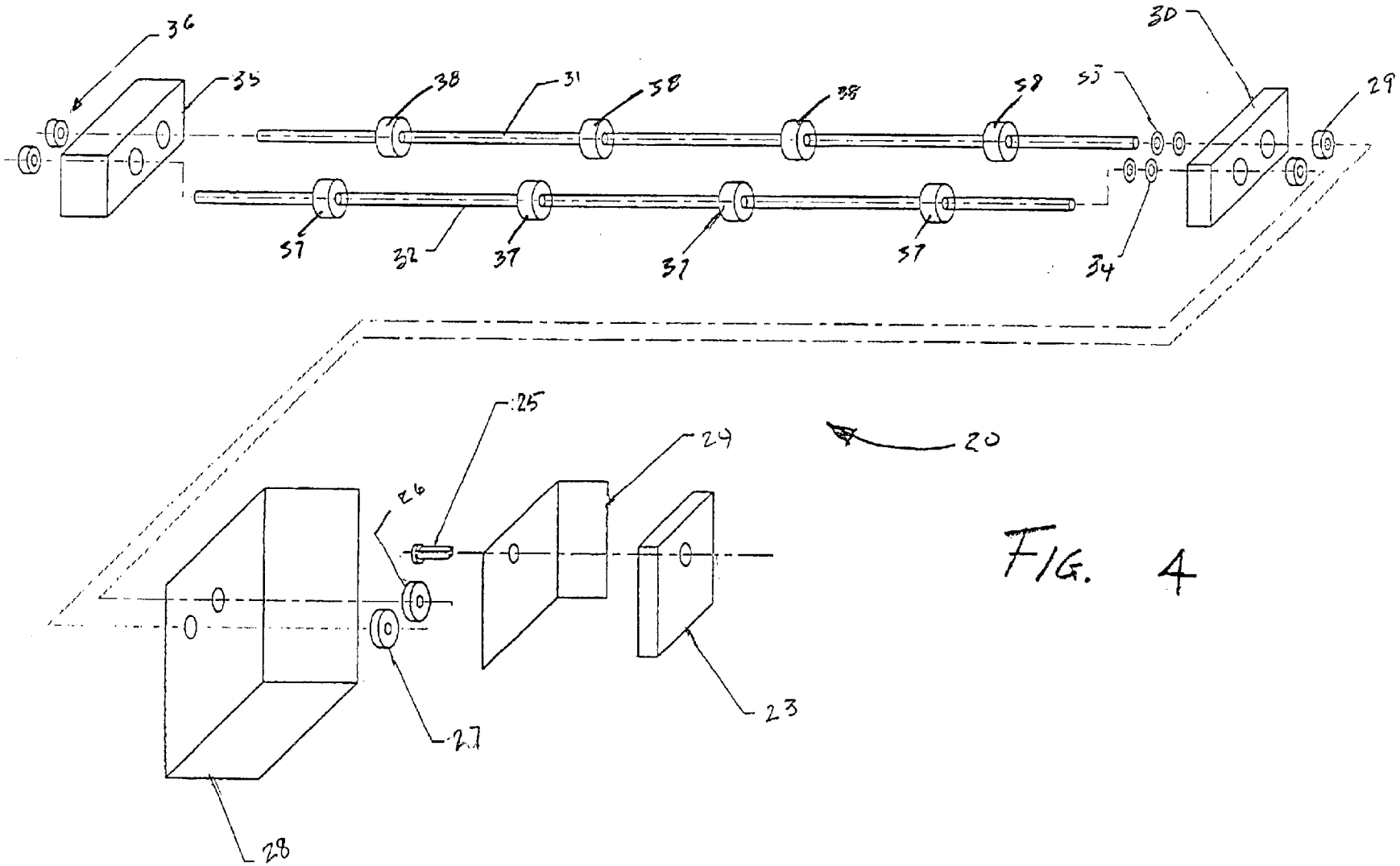
FIG. 4 is an exploded view of the selector and ejector.

As shown in FIG. 4, the dispensing mechanism has a motor 23 controlled and powered by the controller 19. The motor is mounted in the housing by a motor bracket 24. The motor shaft extends through the motor bracket terminating in a drive gear 25. The drive gear 25 engages spur gears 26 and 27 oriented about the drive gear to rotate in opposite directions. The spur gears are supported by the housing mounted gear bracket 28 which carries bearings 29 and shaft bracket 30 for each dispensing shaft 31 and 32. The dispensing shafts 31 and 32 are rotatably fixed to the shaft bracket 30 by retaining rings 33 and 34. The free ends of shafts 31 and 32 are rotatably fixed in another shaft bracket 35 by bearings 36. The other shaft bracket is mounted to the housing for stabilization and support. The shafts 31 and 32 are mounted parallel to each other and each shaft carries a series of rollers 37 and 38, respectively.

Figure 5:
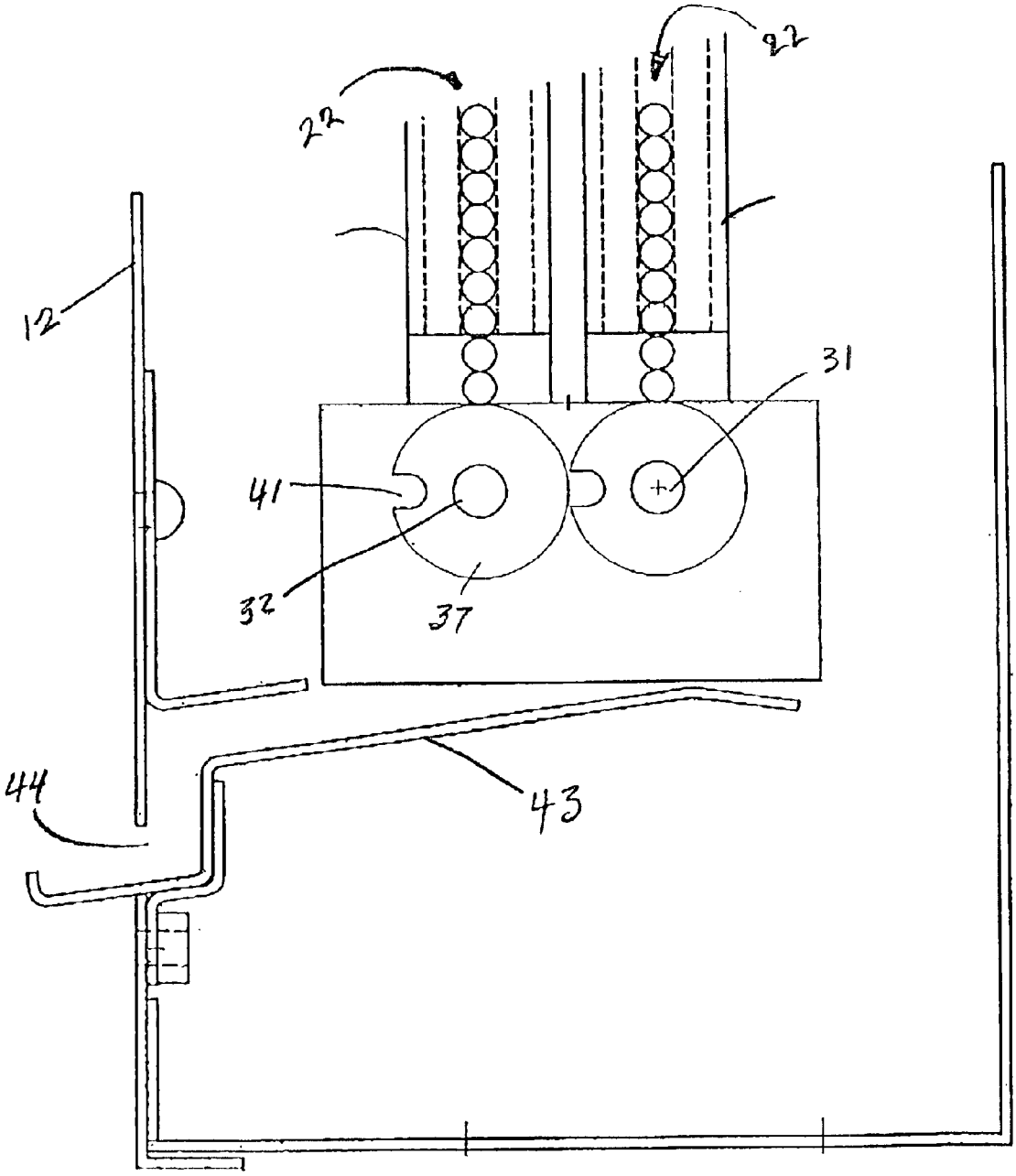
FIG. 5 is a cross section of the vending machine in the START position.

Removably mounted in the vending machine 10, above the shafts 31 and 32, are cartridges 39 and 40, each with a lower opening. The rollers 37 and 38 each rotate adjacent a cartridge opening. The rollers 37 and 38, respectively, each have an interrupted slot 41 and 42 aligned along the length of the shaft. Each slot is approximately the depth of a chemiluminescent necklace so that as a shaft turns, a slot will register with the opening in the cartridge and only one necklace will be selected. As the shaft continues to turn, the necklace will be ejected from the slot by gravity. The necklace will fall onto the dispensing ramp 43. As shown in FIG. 5, the ramp 43 delivers the ejected necklace to the cabinet opening 44. The ramp 43 is disposed to prevent access to the necklaces within the machine.

The rotary shafts 31 and 32 may be oriented to accept a necklace from each cartridge, alternatively. As shown in FIGS. 5 and 6, the slots 41 and 42 are arranged at 90 degrees and 270 degrees from the magazine openings, respectively. As shown, the shafts 31 and 32 turn in opposite directions to register one slot at one opening, alternatively. While this is the preferred embodiment, the dispensing mechanism may operate with the shafts rotating in the same direction and/or the cartridges may be emptied in sequence rather than simultaneously. While two cartridges are shown, there may be more or less cartridges in the machine.

In operation, the vending machine accepts coin, currency or other payment from the customer. Once the payment has been validated by mechanism 17, the controller 19 authorizes the dispensing mechanism 20 to turn the shaft or shafts 31 and 32 a programmed arc to register a slot with an opening in the cartridge. An item falls into the registered slot, while at the same time the other slot is rotated to place it's slot in communication with the ramp 43 to deliver an item. This ends the programmed sequence. As mentioned, other programmed actions can be executed.

The vending machine also may have a device to cease operation when the magazines are empty. For example, a simple counter in the controller could stop the payment mechanism 17 from accepting payment. The counter may be based on the number of revolutions of the shafts, microswitches tripped by the necklaces, interruptions in a light beam or other devices. Further, the vending machine may have the ability, through the controller, to signal a distributor of it's empty status. Microswitches may also be used to determine the presence of a necklace and signal the controller when the cartridges are empty. The controller can then signal the bill changer validator to not accept any more payments.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. An automatic vending machine activated by a payment to dispense one of several elongated chemiluminescent flexible items comprising a payment validator for authenticating proper payment, a controller connected to said payment validator and an elongated chemiluminescent flexible item dispenser, said controller authorizing said elongated chemiluminescent flexible item dispenser to eject one of the several elongated chemiluminescent flexible items from said elongated chemiluminescent item dispenser upon authentication of payment whereby said vending machine automatically dispenses one elongated chemiluminescent flexible item upon a payment, and wherein said controller signals said elongated chemiluminescent flexible item dispenser to move to a position to select another of said several elongated chemiluminescent flexible items subsequent to said step of ejecting.

2. An automatic vending machine of claim 1 wherein said elongated chemiluminescent flexible items are necklaces.

3. An automatic vending machine of claim 1 wherein said controller, said payment validator, and said elongated chemiluminescent flexible item dispenser are enclosed in a secure housing, said housing including an opening for payment, said opening connected to said payment validator, said housing having a dispensing opening, and a ramp disposed in said housing to convey said ejected elongated chemiluminescent flexible item to said dispensing opening.

4. An automatic vending machine of claim 3 wherein said housing includes a magazine operatively associated with said elongated chemiluminescent flexible item dispenser, said several elongated chemiluminescent flexible items stored in said magazine, said elongated chemiluminescent flexible item dispenser selecting one of said several elongated chemiluminescent flexible items to be ejected from said magazine.

5. An automatic vending machine of claim 4 wherein said several elongated chemiluminescent flexible items are uniformly disposed in a cartridge, said cartridge removably positioned in said magazine, said cartridge having an opening connecting with said magazine and said elongated chemiluminescent flexible item dispenser whereby when said several elongated chemiluminescent flexible items are dispensed said cartridge can be replaced.

6. An automatic vending machine of claim 5 wherein each of said several elongated chemiluminescent flexible items has a flexible container enclosing a chemiluminescent light source whereby each of said elongated chemiluminescent flexible items glow upon activation of said chemiluminescent light source.

7. An automatic vending machine of claim 1 wherein each of said several elongated chemiluminescent flexible items has a flexible container enclosing a chemiluminescent light source whereby each of said elongated chemiluminescent flexible items glow upon activation of said chemiluminescent light source.

8. An automatic vending machine for dispensing individual elongated items comprising a housing, said housing having a payment device and a dispensing opening, said payment device operatively connected to a payment validator in said housing, said payment validator operatively connected to a controller, said controller operatively connected to a dispensing mechanism mounted in said housing, said mechanism including at least two magazines each with an inlet and an outlet, each said outlet in the form of an elongated opening approximating the length of said elongated items, an elongated item selector rotatably disposed at each outlet having a long axis, each of said elongated item selectors rotatably fixed to rotate about said axis in said housing adjacent said magazine outlet associated therewith, each said elongated item selectors having a plurality of elongated grooves parallel to said axis, said controller aligning one of said plurality of grooves with each said outlet to alternatively select one item from each magazine, one of said several individual items deposited in one of said plurality of said elongated grooves, said controller commanding rotation of said item selector upon validated payment, said one of said several individual items being ejected from one of said plurality of said grooves to said dispensing opening.

9. An automatic vending machine of claim 8 wherein each of said at least two magazines removably supports a cartridge, said cartridge contains a plurality of individual elongated items, said cartridge having an opening registering with said outlet of each of said at least two magazines.

10. An automatic vending machine of claim 8 wherein a ramp is fixed in said housing extending from said elongated item selectors to said dispensing opening.

* * * * *